US010048611B2

(12) United States Patent
Mimura

(10) Patent No.: US 10,048,611 B2
(45) Date of Patent: Aug. 14, 2018

(54) OPTICAL SCANNING DEVICE AND IMAGE FORMING APPARATUS INCLUDING THE SAME

(71) Applicant: KYOCERA Document Solutions Inc., Osaka (JP)

(72) Inventor: Daisuke Mimura, Osaka (JP)

(73) Assignee: KYOCERA DOCUMENT SOLUTIONS INC., Osaka (JP)

( * ) Notice: Subject to any disclaimer, the term of this patent is extended or adjusted under 35 U.S.C. 154(b) by 0 days.

(21) Appl. No.: 15/631,249

(22) Filed: Jun. 23, 2017

(65) Prior Publication Data

US 2017/0371269 A1 Dec. 28, 2017

(30) Foreign Application Priority Data

Jun. 27, 2016 (JP) ..... 2016-126954

(51) Int. Cl.
*G03G 15/04* (2006.01)
*G03G 21/00* (2006.01)
*G03G 15/00* (2006.01)

(52) U.S. Cl.
CPC ..... *G03G 15/04036* (2013.01); *G03G 15/04* (2013.01); *G03G 21/0005* (2013.01); *G03G 15/6582* (2013.01)

(58) Field of Classification Search
CPC .. G03G 15/04; G03G 15/04036; G03G 21/00; G03G 21/0005; G03G 2215/04; G03G 15/6582; B41J 2/44
See application file for complete search history.

(56) References Cited

U.S. PATENT DOCUMENTS

2002/0133894 A1* 9/2002 Dietrich ..... B60S 1/38 15/250.43
2009/0067862 A1* 3/2009 Nakamura ..... G03G 15/0435 399/51
2014/0119768 A1* 5/2014 Yuki ..... G03G 21/00 399/98
2015/0002914 A1* 1/2015 Takahashi ..... G03G 15/04 358/484
2016/0033890 A1* 2/2016 Sumikura ..... G03G 15/04 347/118

FOREIGN PATENT DOCUMENTS

JP 2011-158566 8/2011

* cited by examiner

*Primary Examiner* — Sophia S Chen
(74) *Attorney, Agent, or Firm* — Wenderoth, Lind & Ponack, L.L.P.

(57) ABSTRACT

An optical scanning device includes a cleaning member held to a holing member and reciprocally moving on a surface of a transparent cover according to reciprocal movement of the holing member, thereby cleaning the surface. The cleaning member is configured such that a front side surface of the cleaning member in a progress direction during the reciprocal movement serves as an inclination surface obliquely crossing the progress direction when viewed from a direction vertical to the surface of the transparent cover, and at an outer side of the transparent cover in a direction perpendicular to the progress direction, a concave portion is formed to collect foreign matters moving to the outer side along the inclination surface according to the movement of the cleaning member.

4 Claims, 15 Drawing Sheets

OPTICAL SCANNING DEVICE AND IMAGE FORMING APPARATUS INCLUDING THE SAME

CROSS-REFERENCE TO RELATED APPLICATION

This application is based upon and claims the benefit of priority from Japanese Patent Application No. 2016-126954 filed on Jun. 27, 2016, the entire contents of which are incorporated herein by reference.

BACKGROUND

The technology of the present disclosure relates to an optical scanning device and an image forming apparatus including the same.

An image forming apparatus employing an electrophotographic system such as a copy machine and a printer includes an optical scanning device that emits light for forming an electrostatic latent image on a photoreceptor.

The optical scanning device has a housing that receives a polygon mirror, an image forming lens and the like. The housing is formed with light emitting ports from which light is emitted. The light emitting port includes an opening extending in a predetermined direction. The light emitting port is closed by a transparent cover such as a dustproof glass.

When dirt, dust and the like due to toner and the like are attached to the surface of the dustproof glass, there is a problem that the optical characteristics of the optical scanning device are deteriorated and thus image failure may occur. In this regard, there has been proposed a cleaning mechanism that regularly cleans the surface of the dustproof glass.

The cleaning mechanism has a screw shaft extending in the same direction as the extension direction of the dustproof glass, and a holding member that holds a cleaning member by engaging with the screw shaft.

The holding member has a cylindrical nut part fitted to the screw shaft, and an arm part that extends from the cylindrical nut part in a direction crossing the screw shaft and holds the cleaning member. The cylindrical nut part is provided on the inner peripheral surface thereof with a spiral protrusion portion (an engagement portion) that engages with a groove formed on the outer peripheral surface of the screw shaft. The groove part of the outer peripheral surface of the screw shaft and the protrusion portion of the inner peripheral surface of the cylindrical nut part engage with each other and the screw shaft is rotated, so that the holding member moves along the screw shaft. The holding member reciprocally moves along a predetermined movement path when a motor is rotated forward and backward. The cleaning member wipes out foreign matters on the surface of the transparent cover according to the movement of the holding member, thereby collecting the foreign matters.

SUMMARY

An optical scanning device according to the present invention includes a housing, a transparent cover, a screw shaft, a holding member, and a cleaning member. The housing has light emitting ports of light, which extend in a predetermined direction. The transparent cover closes the light emitting ports. The screw shaft is arranged so as to extend in the aforementioned predetermined direction along the transparent cover. The screw shaft freely rotates. The screw shaft is formed on a peripheral surface thereof with a spiral groove. The holding member has a cylindrical nut part fitted to and engaged with the screw shaft. The holding member reciprocally moves along the aforementioned predetermined direction according to rotation of the screw shaft. The cleaning member is held to the holing member. The holing member reciprocally moves, so that the cleaning member reciprocally moves on a surface of the transparent cover to clean the surface.

The cleaning member is configured such that a front side surface of the cleaning member in a progress direction during the reciprocal movement serves as an inclination surface obliquely crossing the progress direction when viewed from a direction vertical to the surface of the transparent cover. At an outer side of the transparent cover in a direction perpendicular to the aforementioned progress direction, a concave portion is formed to allow foreign matters moving to the outer side along the aforementioned inclination surface according to the movement of the cleaning member be fallen.

DETAILED DESCRIPTION

Hereinafter, an example of an embodiment will be described in detail on the basis of the drawings. It is noted that the technology of the present disclosure is not limited to the following embodiments.

<<Embodiment 1>>

Figure 1:
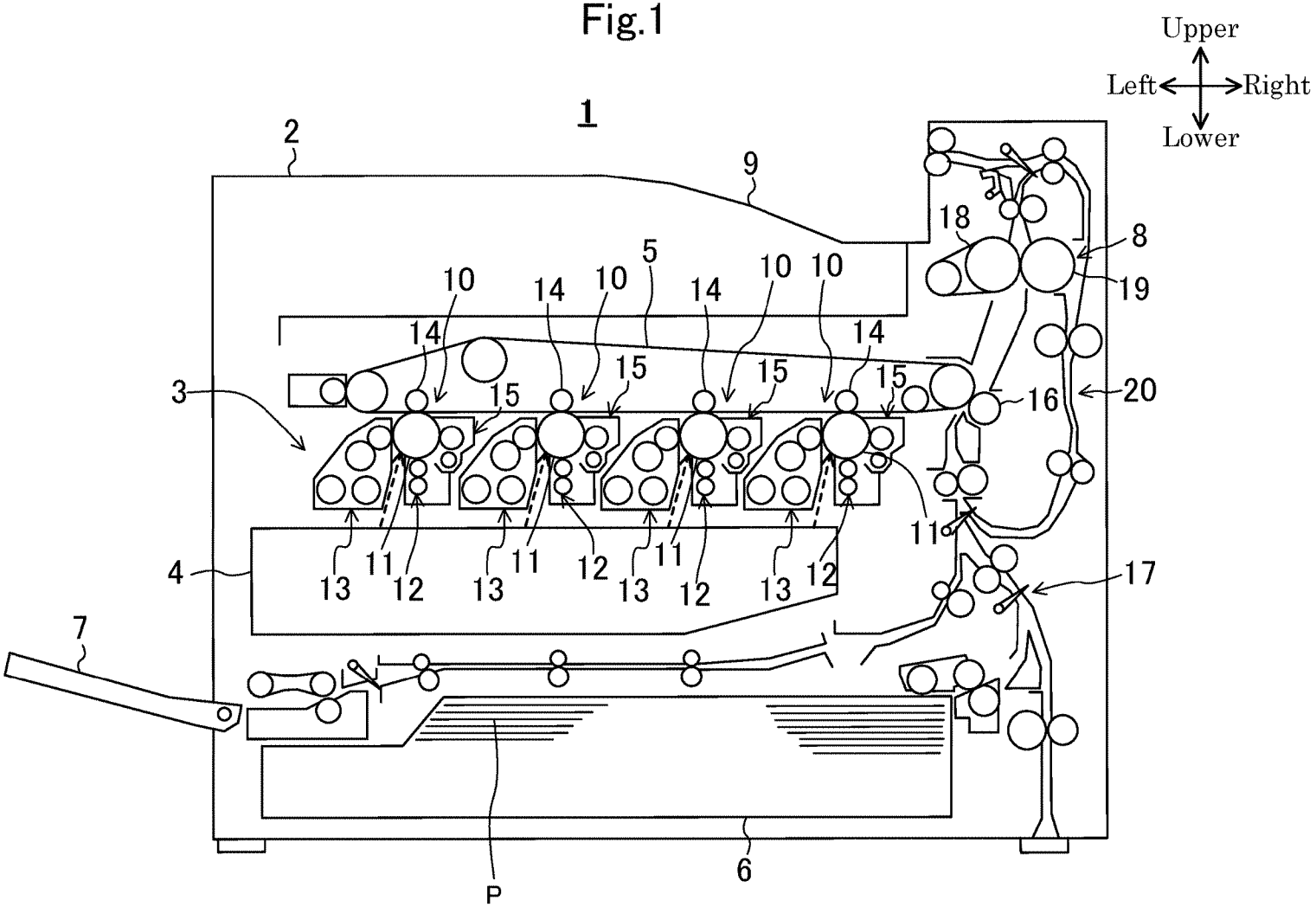
FIG. 1 is a schematic configuration diagram illustrating an image forming apparatus provided with an optical scanning device having a cleaning mechanism in an embodiment.

FIG. 1 illustrates a schematic configuration diagram of an image forming apparatus 1 according to an example of an embodiment. In the following description, it is assumed that, unless stated otherwise, a front side and a rear side indicate a front side and a rear side (a front side and a back side in a direction vertical to the paper surface of FIG. 1) of the image forming apparatus 1, and a left side and a right side indicate a left side and a right side when the image forming apparatus 1 is viewed from the front side.

The image forming apparatus 1 is a tandem type color printer and includes an image forming unit 3 in a box-like casing 2. The image forming unit 3 transfers an image to a recording paper P and forms the image on the recording paper P on the basis of image data transmitted from an external device such as a computer subjected to network connection and the like. Below the image forming unit 3, an optical scanning device 4 is arranged to irradiate laser light, and above the image forming unit 3, a transfer belt 5 is arranged. Below the optical scanning device 4, a paper storage unit 6 is arranged to store the recording paper P, and at the left side of the paper storage unit 6, a manual paper feeding unit 7 is arranged. At a right upper part of the transfer belt 5, a fixing unit 8 is arranged to perform a fixing process on the image transferred to and formed on the recording paper P. A reference numeral 9 indicates a paper discharge unit arranged at an upper portion of the casing 2 to discharge the recording paper P subjected to the fixing process in the fixing unit 8.

The image forming unit 3 includes four image forming units 10 arranged in a row along the transfer belt 5. Each of the image forming units 10 has a photosensitive drum 11. Directly under each photosensitive drum 11, a charging device is arranged, and at the left side of each photosensitive drum 11, a developing device 13 is arranged. Directly above each photosensitive drum 11, a primary transfer roller 14 is arranged, and at the right side of each photosensitive drum 11, a cleaning unit 15 is arranged to clean the peripheral surface of the photosensitive drum 11.

The peripheral surface of each photosensitive drum 11 is uniformly charged by the charging device 12, and laser light corresponding to each color based on the image data inputted from the aforementioned computer and the like is irradiated to the charged peripheral surface of each photosensitive drum 11 from the optical scanning device 4, so that an electrostatic latent image is formed on the peripheral surface of each photosensitive drum 11. A developer is supplied to the electrostatic latent image from the developing device 13, so that a toner image of yellow, magenta, cyan, or black is formed on the peripheral surface of each photosensitive drum 11. These toner images are respectively superposed on and transferred to the transfer belt 5 by a transfer bias applied to the primary transfer roller 14.

A reference numeral 16 indicates a secondary transfer roller arranged below the fixing unit 8 in the state of abutting the transfer belt 5, wherein the recording paper P conveyed along a paper conveyance path 17 from the paper storage unit 6 or the manual paper feeding unit 7 is interposed between the secondary transfer roller 16 and the transfer belt 5, and the toner images on the transfer belt 5 are transferred to the recording paper P by a transfer bias applied to the secondary transfer roller 16.

The fixing unit 8 includes a heating roller 18 and a pressure roller 19, wherein the recording paper P is interposed by the heating roller 18 and the pressure roller 19 so as to be pressed and heated, so that the toner images, which have been transferred to the recording paper P, are fixed to the recording paper P. The recording paper P subjected to the fixing process is discharged to the paper discharge unit 9. A reference numeral 20 indicates a reversing conveyance path for reversing the recording paper P discharged from the fixing unit 8 at the time of duplex printing.

Figure 2:
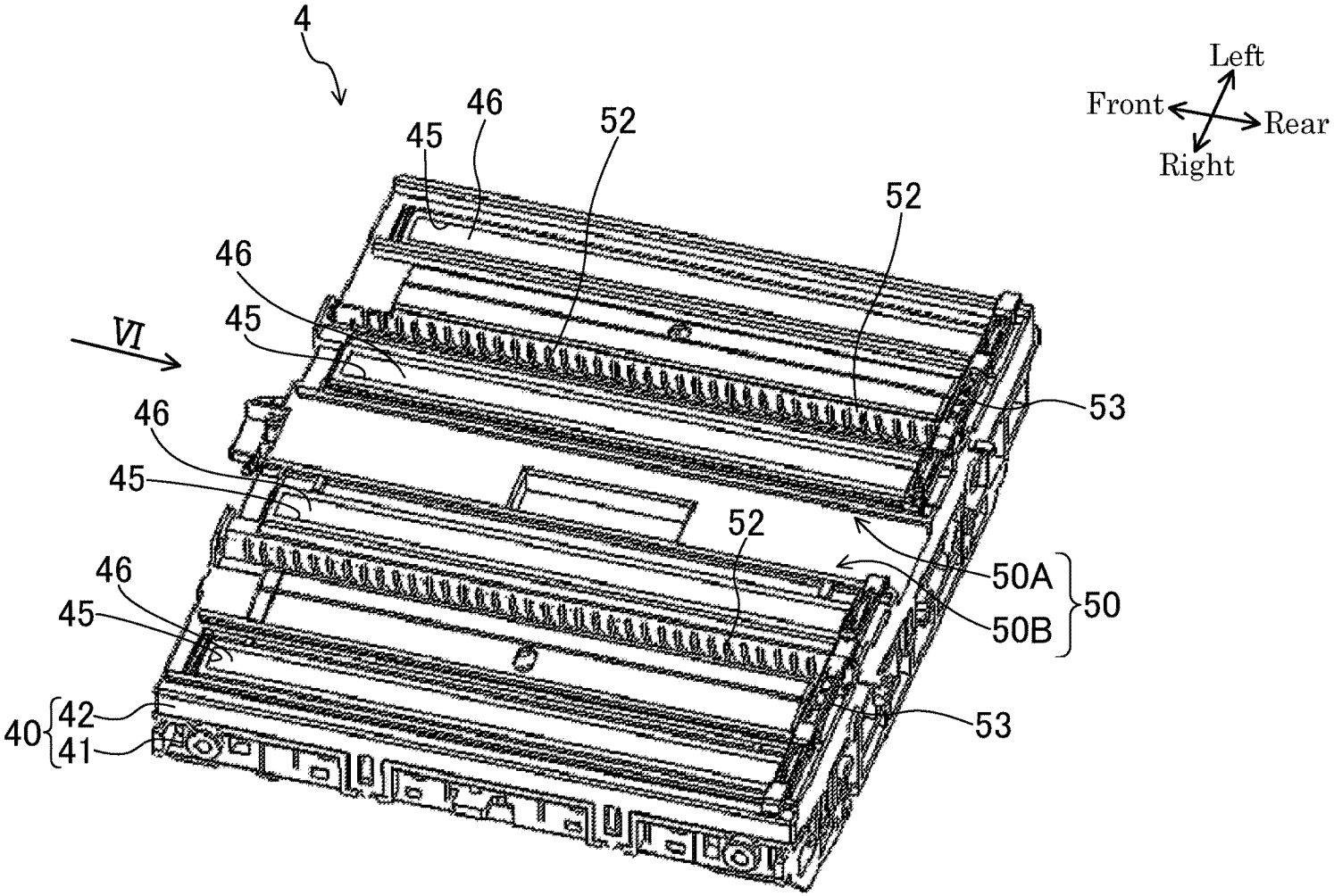
FIG. 2 is an external appearance perspective view of an optical scanning device.

FIG. 2 is an external appearance perspective view of the optical scanning device 4. The optical scanning device 4 includes a sealed box-like housing 40. The housing 40 includes a bottomed box-like housing body 41 in which a ceiling side is opened, and a lid member 42 that closes the ceiling side of the housing body 41.

Figure 3:
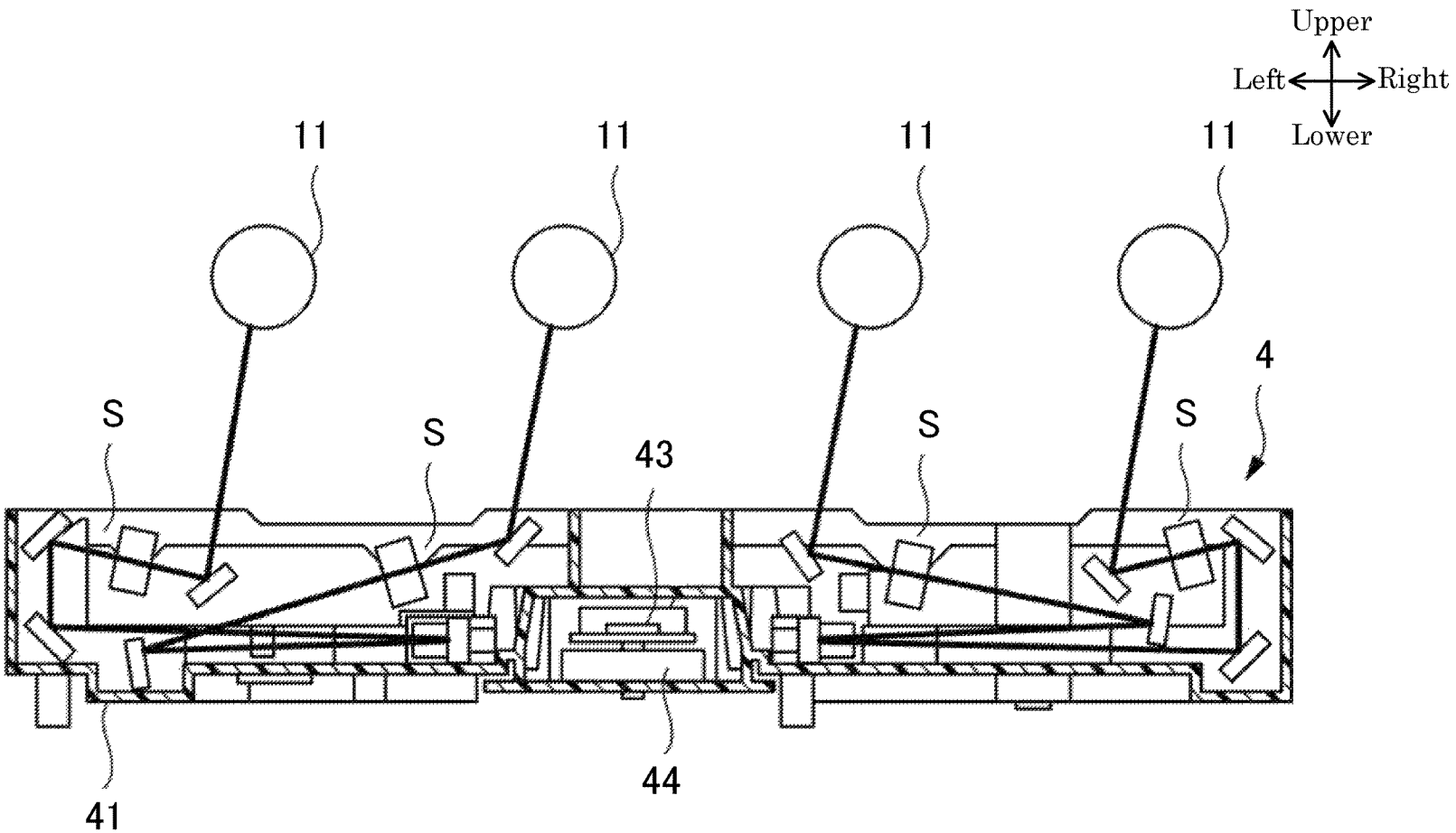
FIG. 3 is a schematic diagram illustrating an internal structure of a housing body of an optical scanning device.

FIG. 3 is a sectional view illustrating a state in which the lid member 42 has been detached from the housing 40 of the optical scanning device 4. At a center portion of a bottom wall of the housing body 41, a polygon mirror 43 and a driving motor 44 for rotationally driving the polygon mirror 43 are arranged. The polygon mirror 43 deflects and scans laser light for electrostatic latent image writing, which is emitted from a light source and corresponds to each color of magenta (M), cyan (C), yellow (Y), and black (K). At the bottom wall of the housing body 41, two pairs of scanning optical systems S, that is, total four scanning optical systems S are arranged at both sides of the polygon mirror 43 while interposing the polygon mirror 43 therebetween. The four scanning optical systems S guide the laser light, which corresponds to each color of the magenta (M), the cyan (C), the yellow (Y), and the black (K), to the surface of each photosensitive drum 11. Each of the scanning optical systems S, for example, is configured by a fθ lens, a reflecting mirror and the like.

As illustrated in FIG. 2, the lid member 42 is formed with two sets of (total four) light emitting ports 45 through which the laser light emitted from the scanning optical systems S passes, wherein one set of light emitting ports 45 form a pair. Each light emitting port 45 includes a rectangular opening extending in a main scanning direction (a front and rear direction). The light emitting ports 45 are formed in parallel with one another in a right and left direction. Each light emitting port 45 is covered by a transparent dustproof glass (a transparent cover) 46 that allows light to pass therethrough. Each dustproof glass 46 covering each light emitting port 45 is formed in a rectangular plate shape long in the main scanning direction (the front and rear direction). The surface of each dustproof glass 46 is automatically cleaned by an automatic cleaning mechanism 50.

The automatic cleaning mechanism 50 has a first automatic cleaning part 50A and a second automatic cleaning part 50B. The first automatic cleaning part 50A and the second automatic cleaning part 50B are symmetrically arranged while interposing a center portion of the housing 40 in the longitudinal direction (the right and left direction) of the housing 40. The first automatic cleaning part 50A cleans two dustproof glasses 46 through which the laser light of the magenta (M) and the cyan (C) passes. The second automatic cleaning part 50B cleans two dustproof glasses 46 through which the laser light of the yellow (Y) and the black (K) passes. The first automatic cleaning part 50A and the second automatic cleaning part 50B are driven by one common driving motor 60 (see FIG. 6). In the present embodiment, the driving motor 60 is configured separately from the optical scanning device 4.

Figure 4:
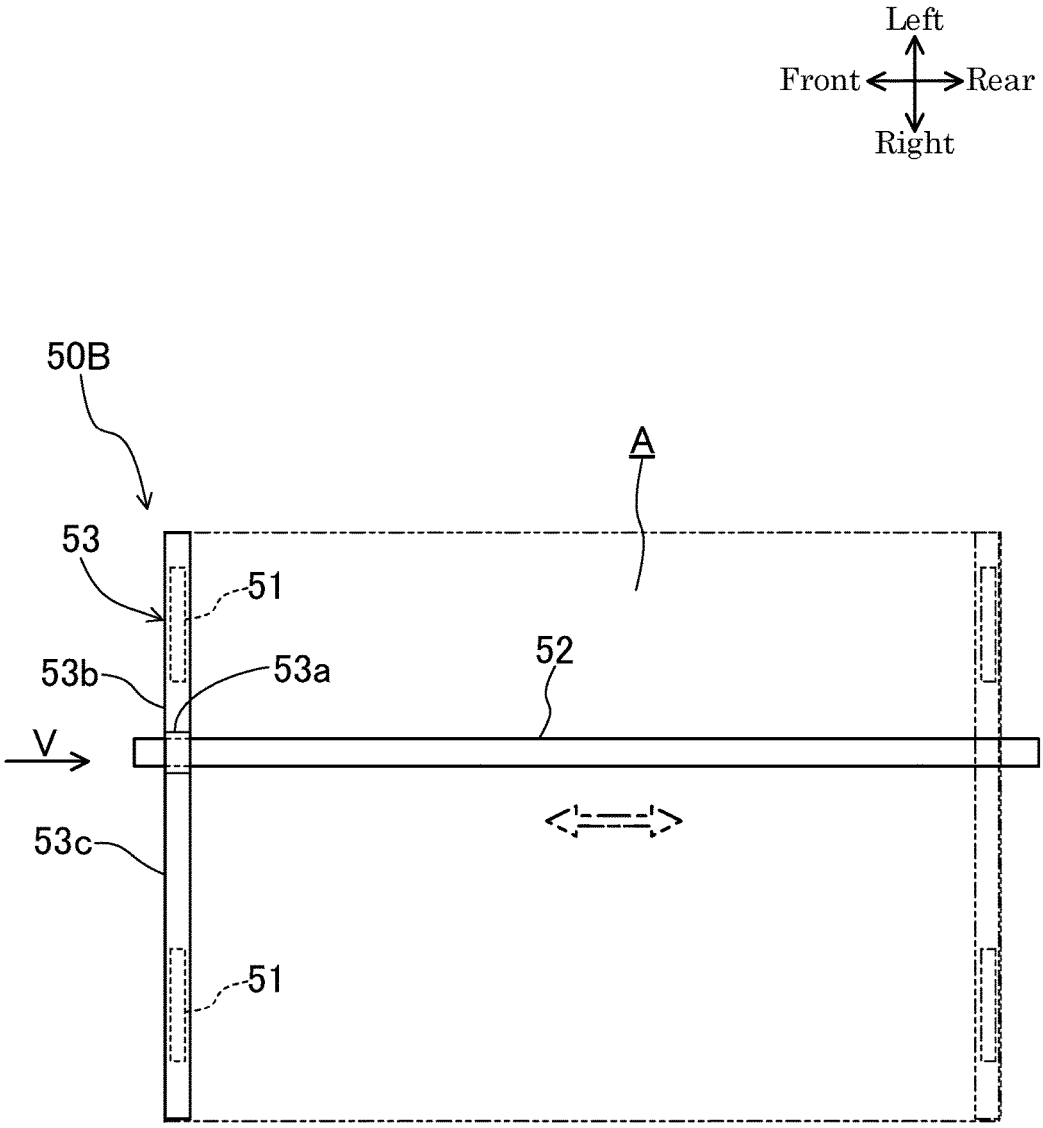
FIG. 4 is a schematic plan view illustrating an automatic cleaning part.
Figure 5:
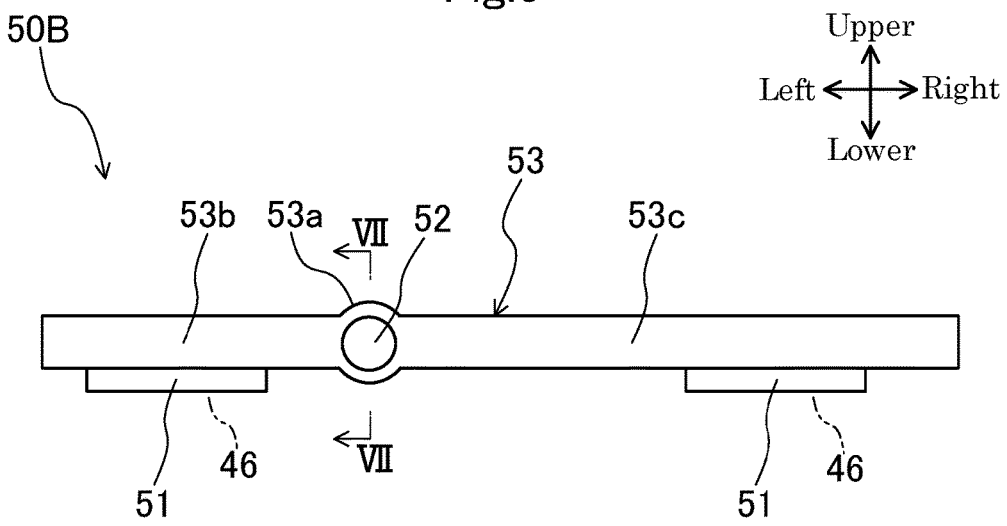
FIG. 5 is a view viewed in the arrow direction of V of FIG. 4.

Since the first automatic cleaning part 50A and the second automatic cleaning part 50B have the same configuration, only the second automatic cleaning part 50B will be described below with reference to FIG. 4 and FIG. 5 and a description of the first automatic cleaning part 50A will be omitted.

The second automatic cleaning part 50B has a screw shaft arranged between a pair of light emitting ports 45, a holding member 53 reciprocally driven by the screw shaft 52, and a pair of cleaning members 51 held by the holding member 53.

Figure 6:
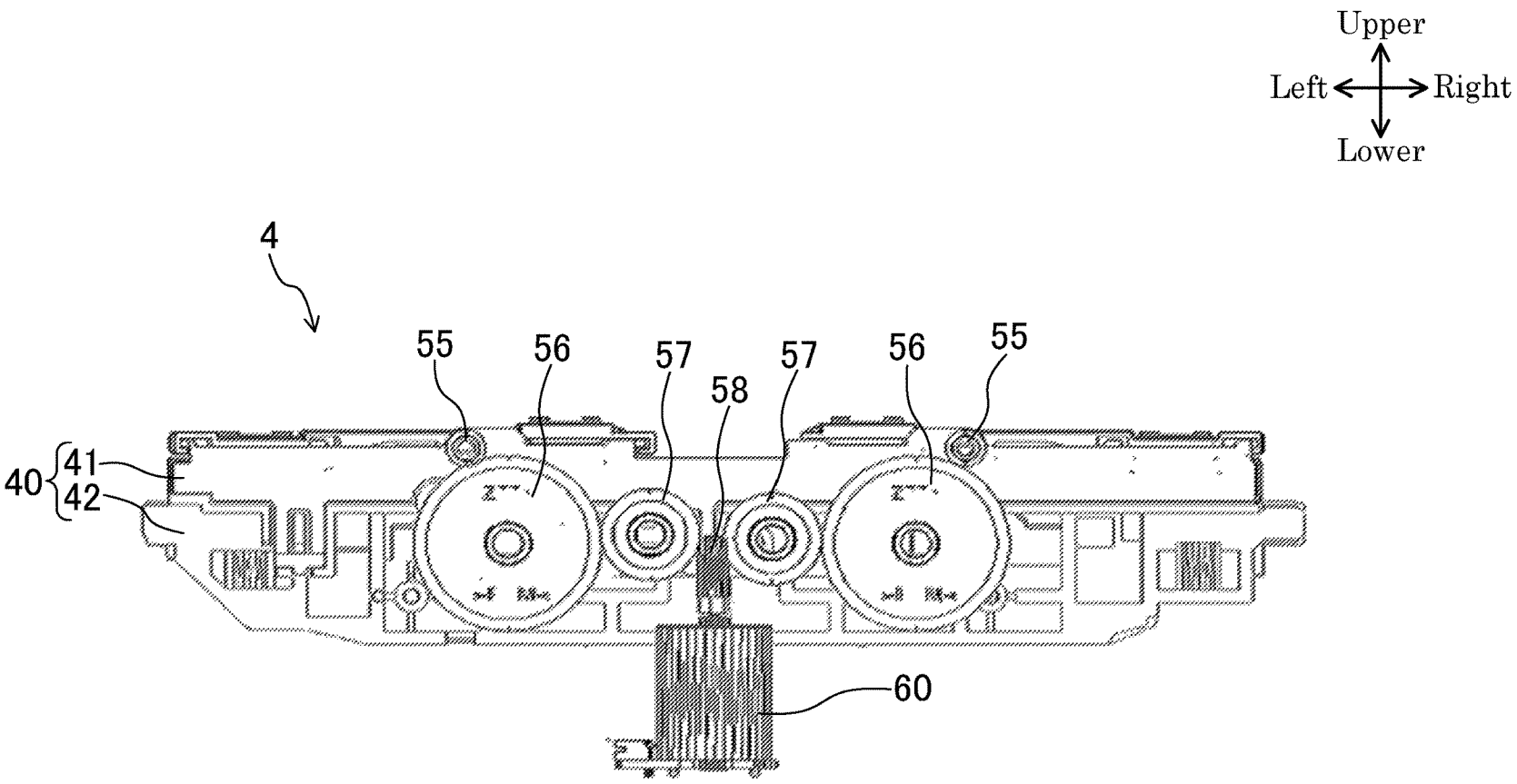
FIG. 6 is a view viewed in the arrow direction of VI of FIG. 2.

The screw shaft 52 is arranged so as to extend in the front and rear direction. Both end portions of the screw shaft in an axial direction (the front and rear direction) are rotatably supported to a bearing part (not illustrated) formed to the lid member 42 of the housing 40. As illustrated in FIG. 6, the screw shaft 52 is mounted at one end portion thereof with driving gears 55. Each driving gear 55 is engaged with a large diameter idle gear 56 supported to a sidewall surface of the housing body 41. Each idle gear 56 is similarly engaged with a small diameter idle gear 57 supported to the sidewall surface. The idle gear 57 is engaged with a motor gear 58 when the optical scanning device 4 is assembled at a predetermined position of the image forming apparatus 1. The motor gear 58 is coaxially fixed to the output shaft of the driving motor 60 fixed to the casing 2. Driving force of the driving motor 60 is transmitted to the screw shaft 52 via the motor gear 58, the idle gear 57, the idle gear 56, and the driving gear 55 in this order.

Figure 7:
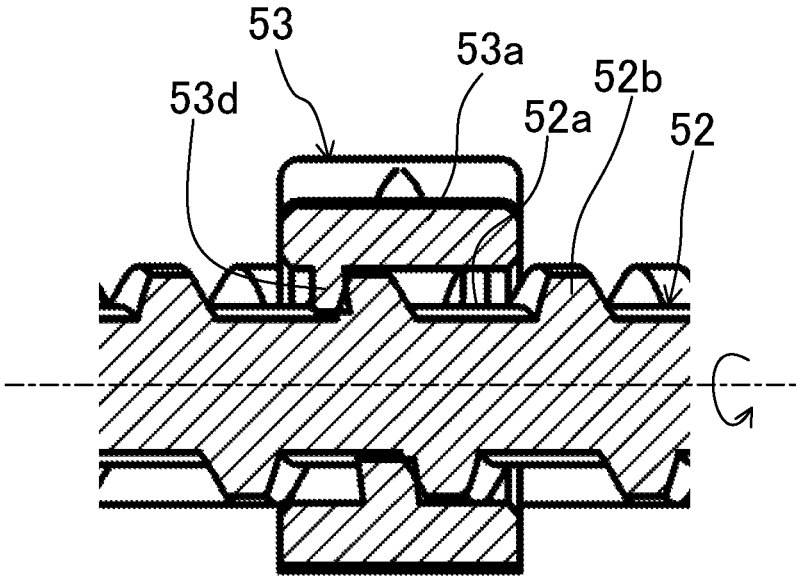
FIG. 7 is a sectional view taken along line VII-VII of FIG. 5.

The screw shaft 52 is formed on the outer peripheral surface thereof with a spiral groove 52*a* (see FIG. 7). The spiral groove 52*a* is formed in the screw shaft 52 in the whole axial direction.

The holding member 53 is arranged across a pair of one set of light emitting ports 45. The holding member 53 has a cylindrical nut part 53*a* (see FIG. 5) fitted to the screw shaft 52, and a first holding plate 53*b* and a second holding plate 53*c* connected to the cylindrical nut part 53*a*.

The cylindrical nut part 53*a* is formed in an approximately cylindrical shape. The cylindrical nut part 53*a* is formed at a position offset to a side near the driving motor 60 from a center position (a center position in the right and left direction) of the holding member 53 in a direction perpendicular to a progress direction. As illustrated in FIG. 7, the cylindrical nut part 53*a* is formed on the inner peripheral surface thereof with an engaging protrusion part 53*d* engaged with the spiral groove 52*a*. The engaging protrusion part 53*d* protrudes radially inside from the inner peripheral surface of the cylindrical nut part 53*a*. The engaging protrusion part 53*d* is formed in a spiral shape around the axial center of the cylindrical nut part 53*a*. The engaging protrusion part 53*d* and the spiral groove 52*a* are engaged with each other with a slight gap. Preferably, this gap, for example, is equal to or more than 0.1 times and is equal to or less than 0.2 times as large as the pitch of the spiral groove 52*a* (that is, a gap between fins 52*b* forming the spiral groove 52*a*). It is preferable that the length of the cylindrical nut part 53*a* in the axial direction (that is, a width of the holding member 53 in a direction perpendicular to the longitudinal direction) is equal to or more than 1.0 times and is equal to or less than 2.0 times as large as the pitch of the spiral groove 52*a*, and in the present embodiment, the length of the cylindrical nut part 53*a* corresponds to 1.0 times of the pitch.

The first holding plate 53*b* extends leftward (one light emitting port 45 side) from an upper end portion of the cylindrical nut part 53*a*, and the second holding plate 53*c* extends rightward (the other light emitting port 45 side) from the upper end portion of the cylindrical nut part 53*a*. The first holding plate 53*b* and the second holding plate 53*c* are arranged on the same straight line extending in the right and left direction when viewed from an upper side. A length from a proximal end to a distal end of the first holding plate 53*b* is shorter than a length from a proximal end to a distal end of the second holding plate 53*c*. The first holding plate 53*b* and the second holding plate 53*c* are mounted at the lower surfaces thereof with the cleaning members 51, respectively. The first holding plate 53*b* is mounted at a front side surface and a rear side surface thereof with compression coil springs (not illustrated), respectively. The compression coil springs push back the holding member 53 and allow the engaging protrusion part 53*d* of the inner peripheral surface of the cylindrical nut part 53*a* to be engaged with the spiral groove 52*a* of the screw shaft 52 when the holding member 53 has reached a moving end of a reciprocal movement path A.

Each cleaning member 51 is formed by an elastic blade member (for example, a silicon pad). Each cleaning member 51 is formed in a rectangular plate shape extending in the longitudinal direction of the holding member 53 when viewed from an upper side. The cleaning members 51 are respectively provided at positions corresponding a pair of dustproof glasses 46 to be cleaned by the automatic cleaning parts 50A and 50B (see FIG. 8). That is, each cleaning member 51 is provided at a position overlapping each dustproof glass 46 in a plan view. Each cleaning member 51 is interposed between the holding plates 53*b* and 53*c* and the dustproof glass 46 and is compressed with a light load in a thickness direction. By so doing, each cleaning member 51 is pressed to the dustproof glass 46 at a predetermined pressing force.

When the automatic cleaning mechanism 50 operates, the screw shaft 52 is rotationally driven in both forward and backward directions by the driving motor 60. By so doing, the holding member 53 reciprocally moves along the reciprocal movement path A.

Figure 8:
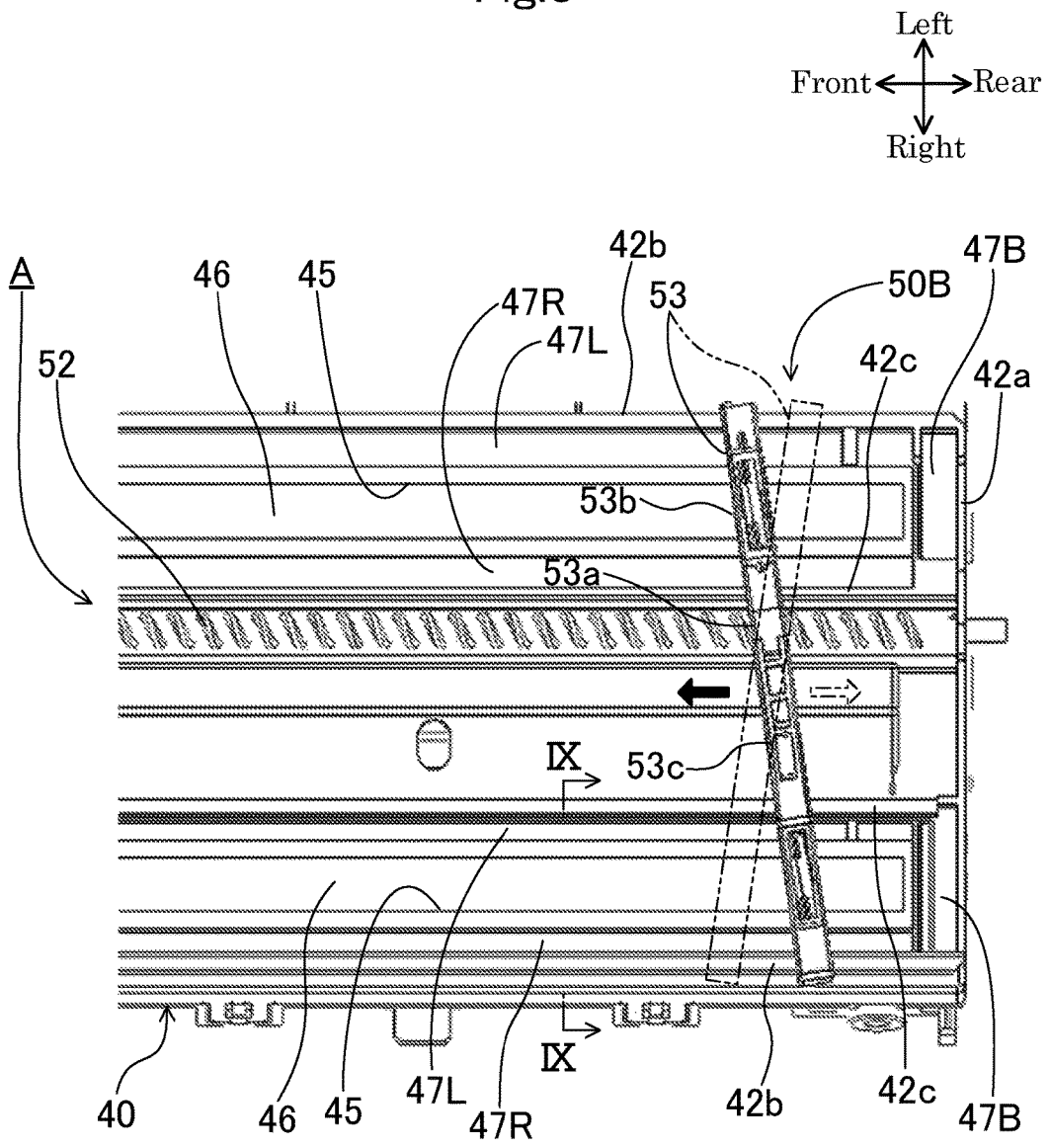
FIG. 8 is a plan view illustrating a state in which a holding member moves from a rear side to a front side.

As illustrated in FIG. 8, the reciprocal movement path A is a linear movement path extending in the front and rear direction. The reciprocal movement path A is surrounded by a front sidewall and a rear sidewall 42*a* facing each other in the front and rear direction (in the drawing, only the rear sidewall is illustrated), and a pair of end portion guide walls 42*b* facing each other in the right and left direction. The front sidewall and the rear sidewall 42*a* are provided with bearing parts (not illustrated) that rotatably support the screw shaft 52. The pair of end portion guide walls 42*b* support both end portions of the holding member 53 in the longitudinal direction from below and guide the movement of the holding member 53 in the front and rear direction. Between the pair of end portion guide walls 42*b*, a pair of intermediate guide walls 42*c* are provided to extend in the front and rear direction in a similar manner. The pair of intermediate guide walls 42*c* respectively support the second holding plate 53*c* and the first holding plate 53*b* from below.

Figure 9:
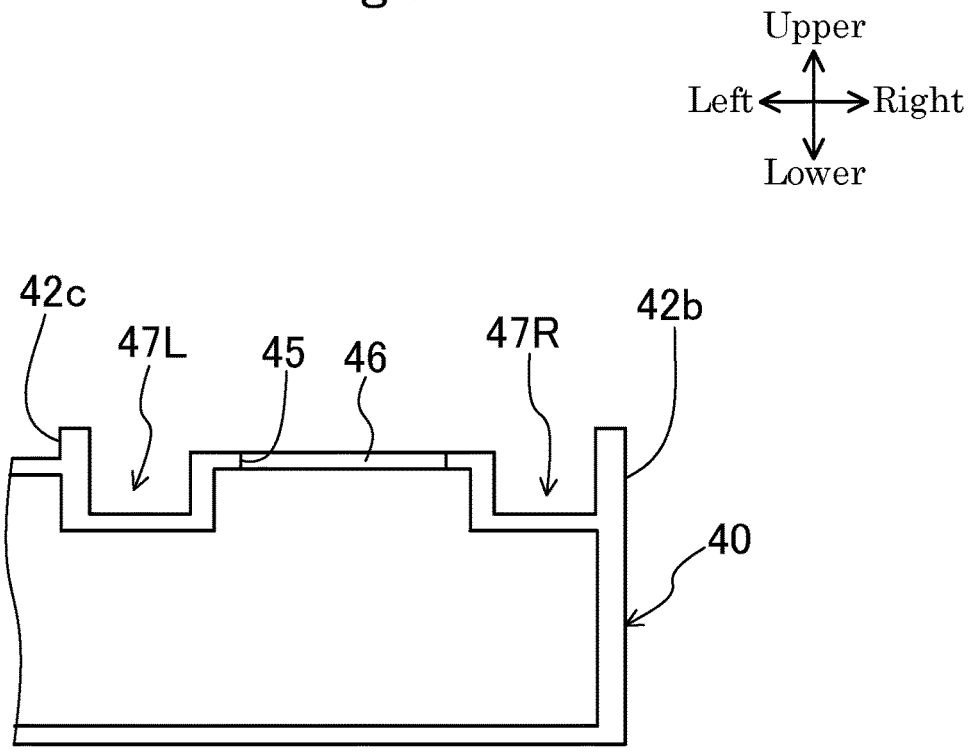
FIG. 9 is a sectional view taken along line IX-IX of FIG. 8.

As illustrated in FIG. 9, the light emitting port 45 is formed at both right and left sides thereof with a left concave portion 47L and a right concave portion 47R respectively. Each of the concave portions 47L and 47R is a concave portion opened upward and having a sectional rectangular shape, and extends along the light emitting port in the front and rear direction. In FIG. 9, the left concave portion 47L is formed adjacent to an intermediate guide wall 42*c* and the right concave portion 47R is formed adjacent to the end portion guide wall 42*b*. Both end positions of each of the concave portions 47L and 47R in the front and rear direction are positioned outside of both end positions of the dustproof glass 46 in the front and rear direction. The dustproof glass 46 is formed at the front side and the rear side thereof with a front concave portion 47F (see FIG. 11) and a rear concave portion 47B (see FIG. 10), which are opened upward.

Next, the movement operation of the holding member 53 will be described with reference to FIG. 8. In the drawing, the solid line indicates the state of the holding member 53 when the screw shaft 52 rotates forward and the two dot chain line indicates the state of the holding member 53 when the screw shaft rotates backward. In any case, the holding member is inclined by 10° to 30° with respect to a direction perpendicular to the screw shaft 52. That is, the holding member 53 is inclined such that the first holding plate 53*b* is positioned at the front side of the second holding plate 53*c* in the progress direction.

The inclination of the holding member 53 is achieved by two characteristics on the previously described structure. The first characteristic is that the screw shaft 52 is engaged with the engaging protrusion part 53*d* of the cylindrical nut part 53*a* at a position offset from the center position of the holding member 53 in the right and left direction (that is, the direction perpendicular to the progress direction). The second characteristic is that the length of the cylindrical nut part 53*a* in the axial direction is set to be equal to or more than 1.0 times and to be equal to or less than 2.0 times as large as the pitch of the spiral groove 52*a*.

As described above, the holding member 53 is inclined during the reciprocal movement, so that the front side surface of the cleaning member 51 in the progress direction obliquely crosses the progress direction when viewed from an upper side (that is, when viewed from a direction vertical to the surface of the dustproof glass 46). In this way, foreign matters can be collected by an inclination surface 51*a* (see FIG. 10) formed at the front side of the cleaning member 51 in the progress direction, and can be fallen into the right and left concave portions 47R and 47L.

Figure 10:
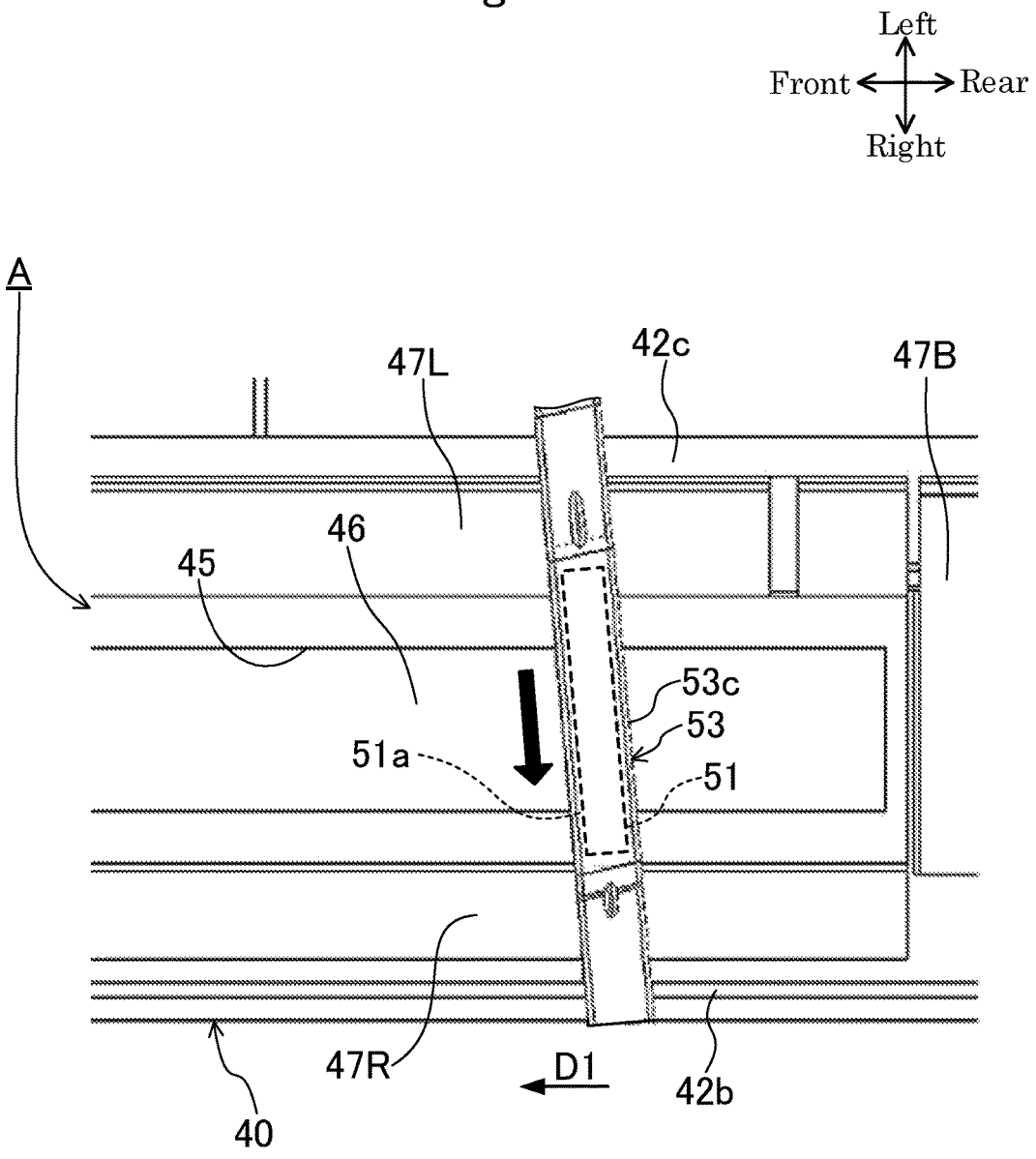
FIG. 10 is an explanation diagram for explaining a movement path of foreign matters collected by a cleaning member when a holding member moves from a rear side to a front side.

Specifically, for example, as illustrated in FIG. 10, when the holding member 53 moves from the rear side to the front side (moves in the direction D1 of FIG. 10), foreign matters on the dustproof glass 46 are collected by the inclination surface 51*a* of the cleaning member 51, are moved outward in the direction perpendicular to the progress direction along the inclination surface 51*a*, and then are fallen into the right concave portion 47R. That is, the foreign matters on the dustproof glass 46 are fallen into the right concave portion 47R without being accumulated at the front side of the cleaning member 51 in the progress direction. It is noted that when the holding member 53 has reached at the front side end of the reciprocal movement path A, the cleaning member 51 is positioned at an upper side of the front concave portion 47F (illustrated only in FIG. 11). Consequently, foreign matters remaining on the dustproof glass 46 without being fallen into the right concave portion 47R can be fallen into the front concave portion 47F.

Figure 11:
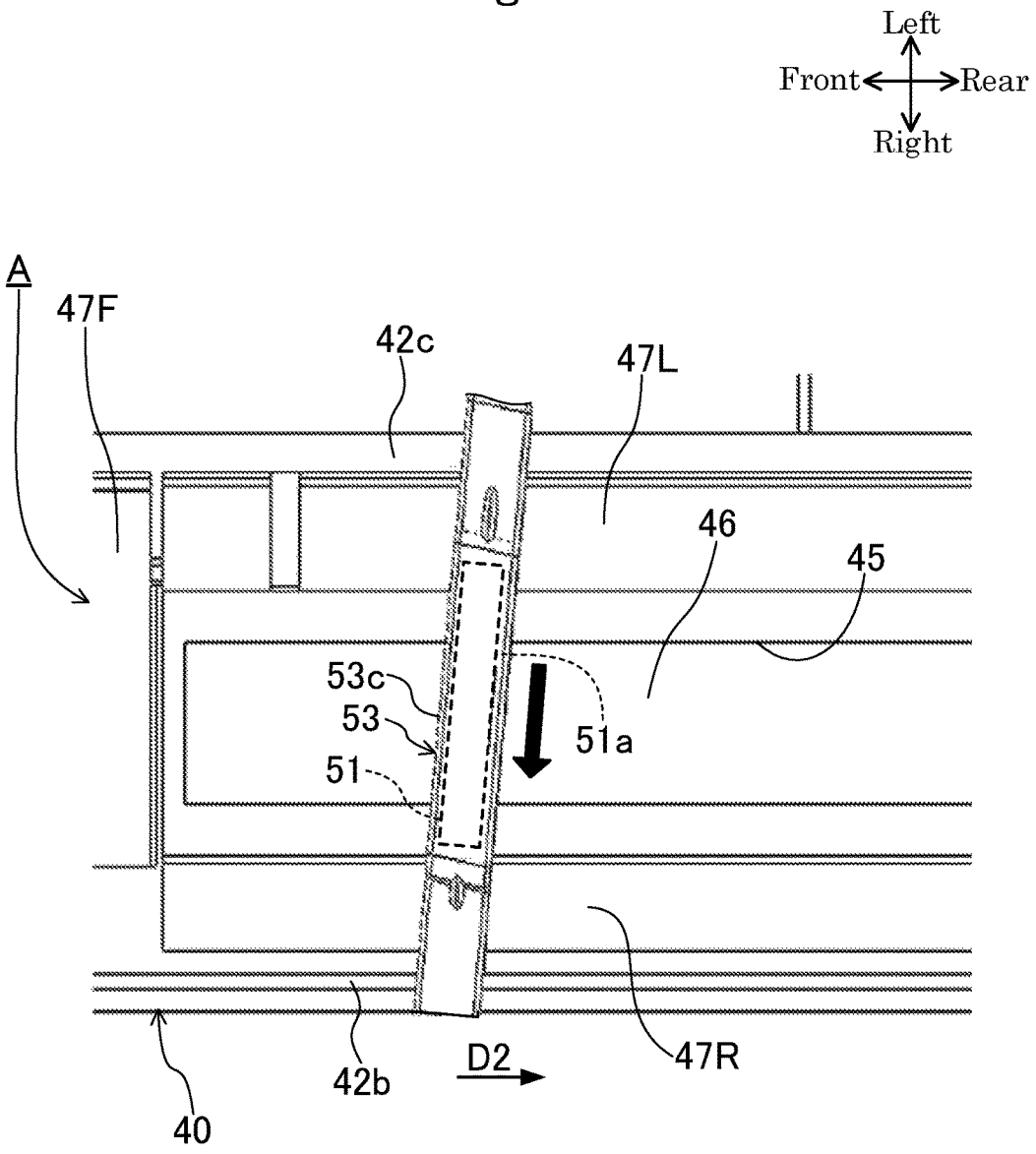
FIG. 11 is an explanation diagram for explaining a movement path of foreign matters collected by a cleaning member when a holding member moves from a front side to a rear side.

As illustrated in FIG. 11, when the holding member 53 moves from the front side to the rear side (moves in the direction D2 of FIG. 11), the inclination direction of the holding member is reversed to that of FIG. 10. However, even in this case, the front side surface (the rear side surface of the image forming apparatus 1) of the cleaning member 51 in the progress direction constitutes the inclination surface 51*a*. Consequently, foreign matters on the dustproof glass 46 are moved outward in the direction perpendicular to the progress direction along the inclination surface 51*a* according to the movement of the holding member 53, and are fallen into the right concave portion 47R. It is noted that when the holding member 53 has reached at the rear side end of the reciprocal movement path A, the cleaning member 51 is positioned at an upper side of the rear concave portion 47B. Consequently, foreign matters remaining on the dustproof glass 46 without being fallen into the right concave portion 47R can be fallen into the rear concave portion 47B.

As described above, in the embodiment 1, the holding member 53 moves from one end side to the other end side of the dustproof glass 46, so that the front side surface of the cleaning member 51 in the progress direction constitutes the inclination surface 51*a*. Accordingly, foreign matters on the dustproof glass 46 can be collected by the inclination surface 51*a*, and the collected foreign matters can be lead to and fallen into the right concave portion 47R.

By so doing, the holding member 53 moves from one end side to the other end side in the front and rear direction, so that it is possible to prevent foreign matters being accumulated at the front side of the cleaning member 51 in the progress direction. Accordingly, it is possible to prevent driving force required for driving the holding member 53 from being increased by an increase in sliding resistance of the cleaning member 51. By so doing, driving torque of the driving motor 60, which is a driving source of the holding member 53, can be maintained to be almost constant. Thus, there is no increase in a time required for the reciprocal movement of the holding member 53 due to a change in the driving torque of the driving motor 60. Furthermore, when the driving and stop of the driving motor 60 are controlled by a timer, the driving motor 60 does not stop by a change in the driving torque of the driving motor 60 before the holding member 53 reaches the moving end. Furthermore, since it is not necessary to change the driving torque of the driving motor 60 according to a change in the sliding resistance of the cleaning member 51, it is possible to simplify the driving circuit of the driving motor 60. Furthermore, since it is not necessary to provide a torque detection sensor with high precision, it is possible to reduce the entire cost of the apparatus.

Furthermore, in the embodiment 1, the cylindrical nut part 53*a* engaged with the screw shaft 52 is formed at a position offset to a side near the driving motor 60 from the center position of the holding member 53 in the direction perpendicular to the progress direction.

By so doing, the distance between the driving gear 55 of the screw shaft 52 and the motor gear 58 is maximally shortened, so that it is possible to reduce the number of idle gears provided between both gears 55 and 58. Thus, the number of parts is reduced, so that it is possible to reduce the cost of the entire apparatus.

<Embodiment 2>

Figure 12:
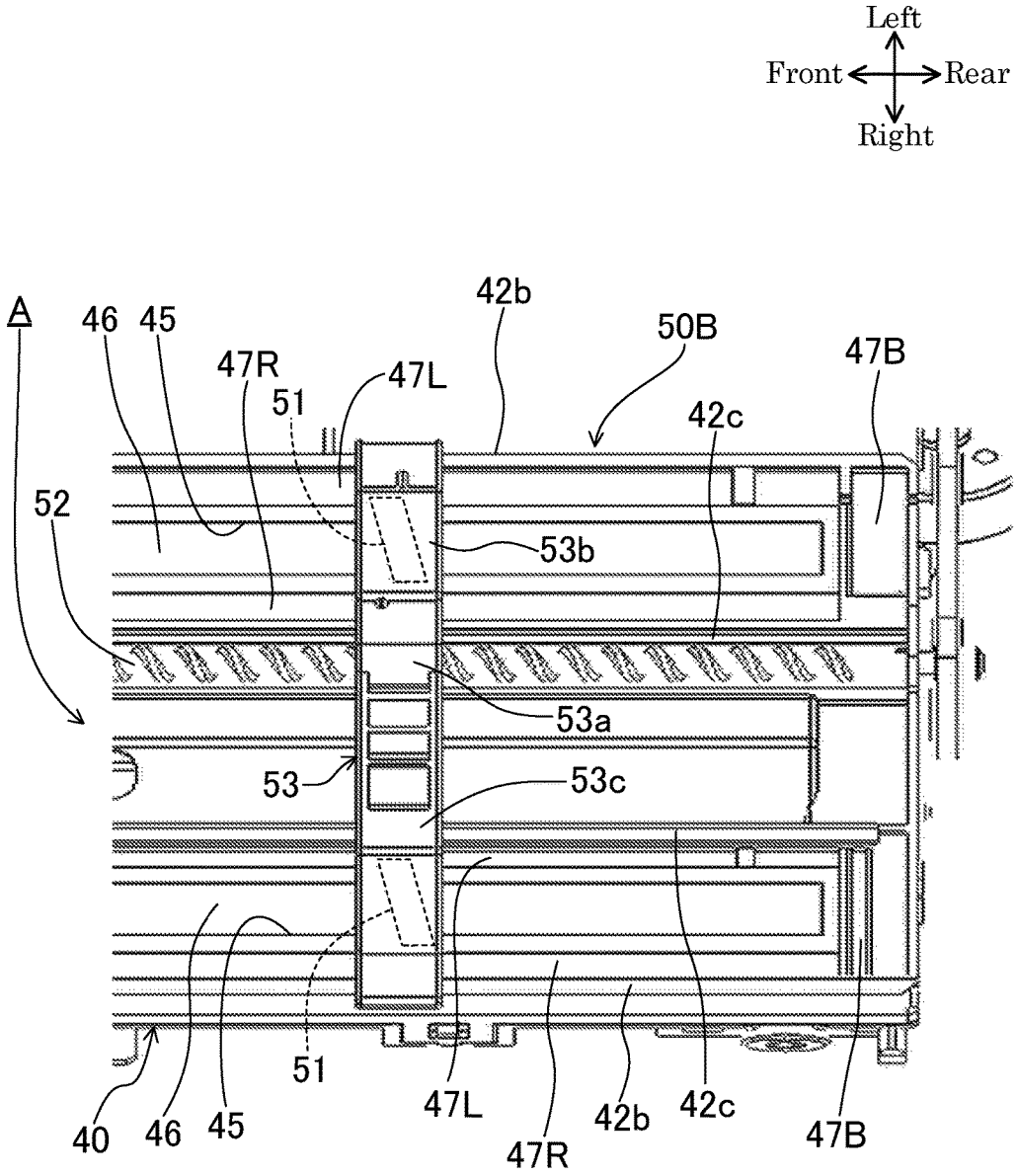
FIG. 12 is a view corresponding to FIG. 8, which illustrates an embodiment 2.
Figure 13:
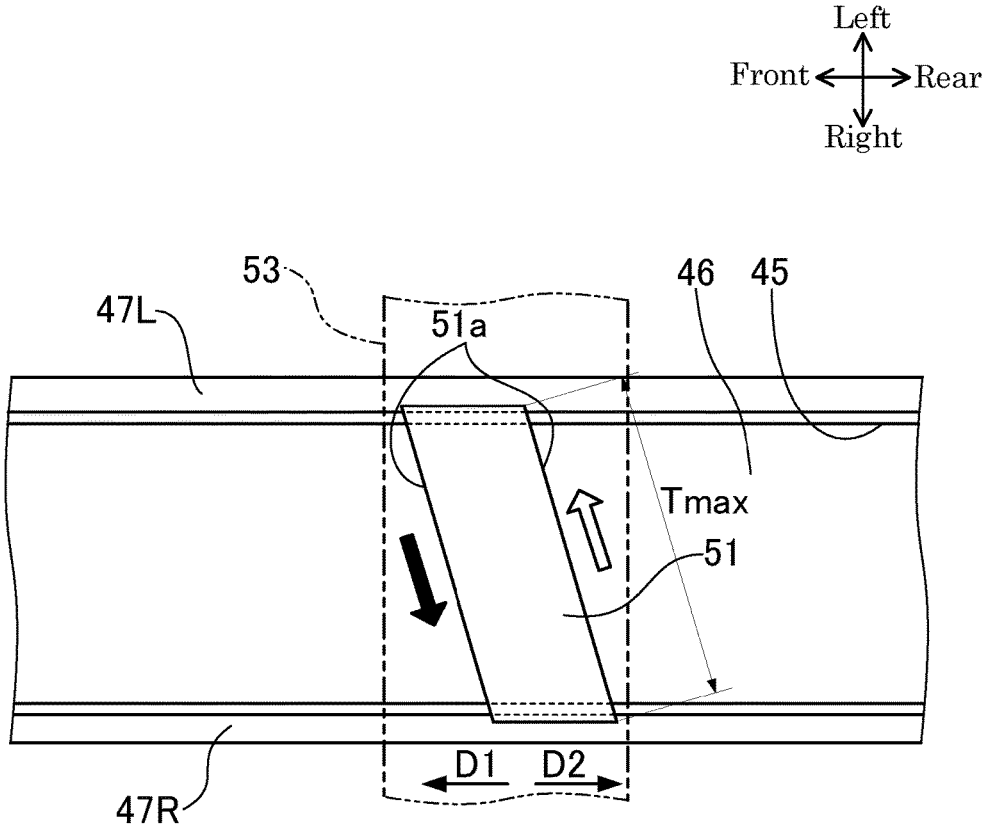
FIG. 13 is an explanation diagram for explaining a movement path of foreign matters collected by a cleaning member when a holding member reciprocally moves in a front and rear direction

FIG. 12 and FIG. 13 illustrate the embodiment 2. This embodiment is different from the embodiment 1 in that the holding member 53 is not allowed to cross the progress direction and the cleaning member 51 is arranged so as to cross the progress direction. It is noted that the same reference numerals are used to designate the same elements as those of the embodiment 1 in FIG. 12 and FIG. 13 and a detailed description thereof is omitted.

That is, in the present embodiment, the cleaning member extends in a linear shape in the direction crossing the progress direction when viewed from an upper side. It can be said that the cleaning member 51 has a parallelogram shape having two oblique sides extending in the direction crossing the progress direction when viewed from the upper side. Sides corresponding to the two oblique sides constitute the inclination surface 51*a* crossing the progress direction.

The configuration of the holding member 53 is approximately the same that of the embodiment 1, but a width of the holding member 53 in a direction perpendicular to the longitudinal direction is different from that of the embodiment 1. That is, the width of the holding member 53 (that is, the length of the cylindrical nut part 53*a* in the axial direction) is larger than twice of the pitch of the spiral groove 52*a*. When this width is excessively large, since the length of the reciprocal movement path A increases, the optical scanning device 4 increases in size, so that the width is preferably equal to or less than three times as large as the pitch of the spiral groove 52*a* of the holding member 53. As described above, the width of the holding member 53 is allowed to be larger as compared with the embodiment 1, so that the holding member 53 can be allowed to reciprocate in the state of being perpendicular to the progress direction.

When the holding member 53 moves from the rear side to the front side (moves in the direction D1 of FIG. 13), foreign matters are moved outward in the direction perpendicular to the progress direction along the inclination surface 51*a* at the front side of the cleaning member 51 in the progress direction, and are fallen into the right concave portion 47R (see the black arrow of the drawing). On the other hand, when the holding member 53 moves from the front side to the rear side (moves in the direction D2 of FIG. 13), foreign matters are moved outward in the direction perpendicular to the progress direction along the inclination surface 51*a* at the front side of the cleaning member 51 in the progress direction, and are fallen into the left concave portion 47L (see the white arrow of the drawing). Consequently, it is possible to obtain operations and effects similar to those of the embodiment 1.

Moreover, since the holding member 53 reciprocates in the state of being perpendicular to the progress direction, when the holding member 53 has reached the moving end of the reciprocal movement path A, it is possible to prevent the occurrence of an unwiped area of the dustproof glass 46 by the cleaning member 51.

<Modification>

Figure 14:
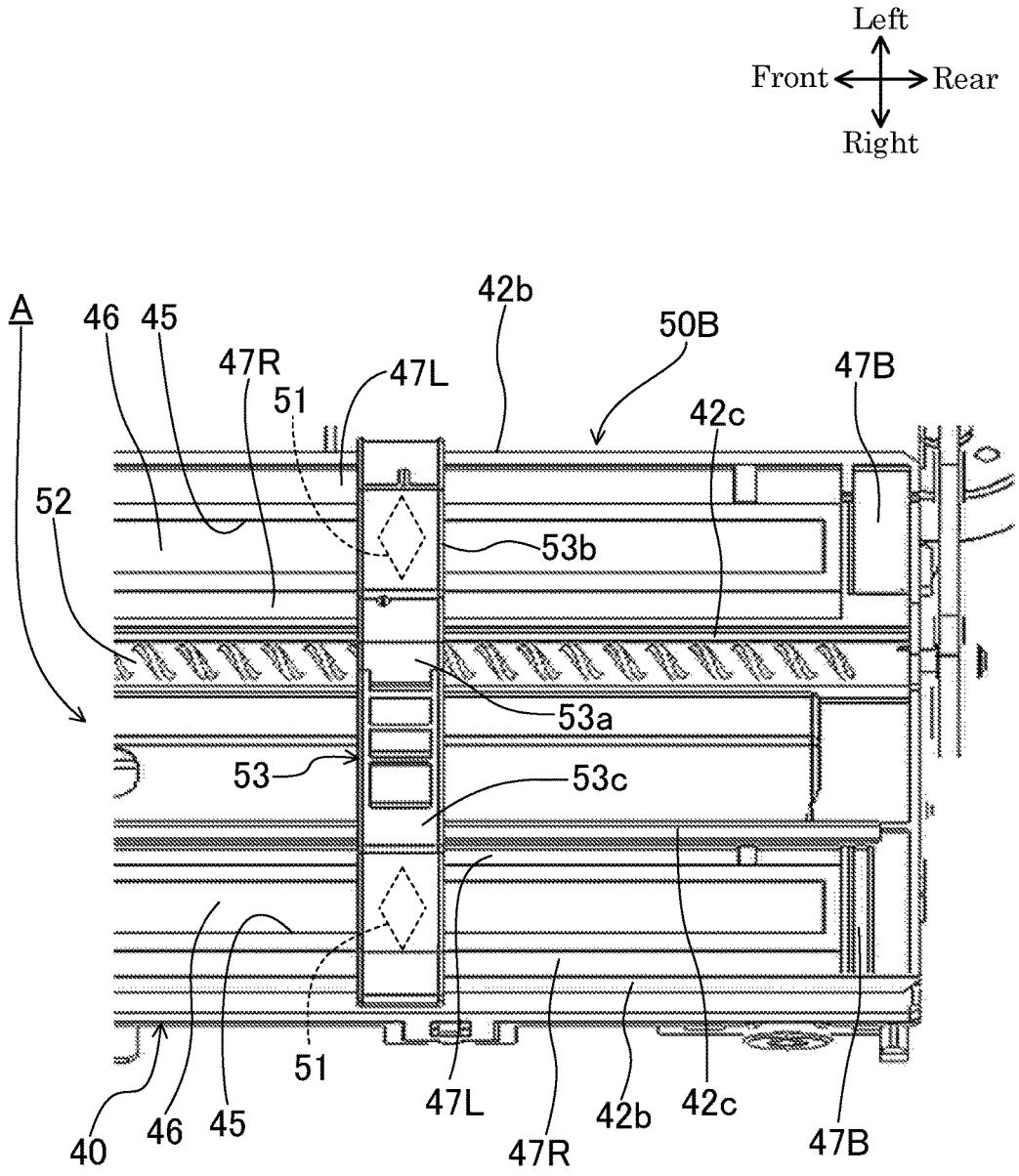
FIG. 14 is a modification of an embodiment 2, corresponding to FIG. 12, which illustrates embodiment 2.
Figure 15:
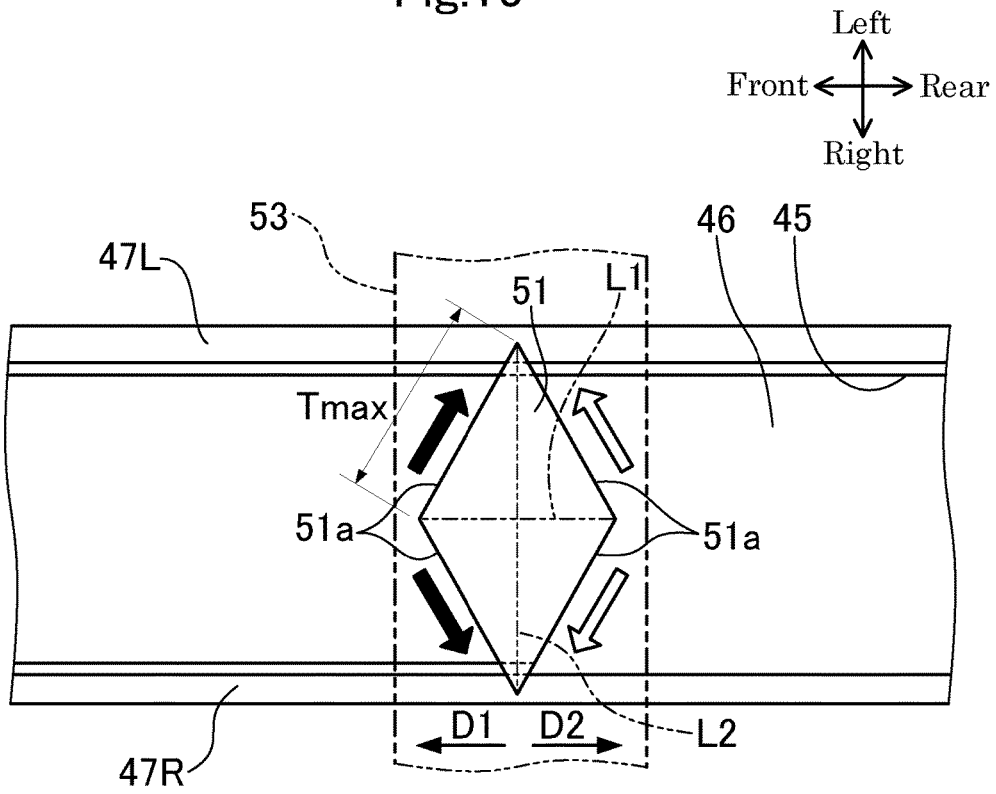
FIG. 15 is a modification of an embodiment 2, corresponding to FIG. 13, which illustrates embodiment 2.

FIG. 14 and FIG. 15 illustrate a modification of the embodiment 2. In the modification, the shape of the cleaning member 51 is allowed to be different from that of the embodiment 2. It is noted that the same reference numerals are used to designate the same elements as those of the embodiment 2 in FIG. 14 and FIG. 15 and a detailed description thereof is omitted.

That is, in the present modification, the cleaning member 51 has a diamond shape viewed from an upper side. One diagonal L1 of the diamond extends in the progress direction of the holding member 53, and the other diagonal L2 extends in the direction perpendicular to the progress direction. Four sides corresponding to the four oblique sides of the diamond constitute the inclination surface 51*a* crossing the progress direction. The position of the diagonal L1 coincides with the center position of the dustproof glass 46 in the width direction (the top and bottom direction in FIG. 14 and FIG. 15). The position of the diagonal L2 coincides with the center position of the holding member 53 in the width direction (the right and left direction in FIG. 14 and FIG. 15).

When the holding member 53 moves from the rear side to the front side (moves in the direction D1 of FIG. 15), foreign matters are moved outward in the direction perpendicular to the progress direction along the two inclination surfaces 51*a* at the front side of the cleaning member 51 in the progress direction as indicated by the black arrows of the drawing, and when the holding member 53 moves from the front side to the rear side (moves in the direction D2 of FIG. 15), foreign matters are moved outward in the direction perpendicular to the progress direction along the two inclination surfaces 51*a* at the front side of the cleaning member 51 in the progress direction as indicated by the white arrows of the drawing. By so doing, the moved foreign matters are fallen into the left concave portion 47L and the right concave portion 47R. Consequently, it is possible to obtain operations and effects similar to those of the embodiment 2.

Moreover, in the present modification, it is possible to shorten a maximum movement distance $T_{max}$ from the point where foreign matters are collected by the cleaning member 51 to the point where the foreign matters are fallen into the left concave portion 47L (or the right concave portion 47R), as compared with the embodiment 2 (the case of FIG. 13). Thus, it is possible to allow foreign matters collected by the cleaning member 51 to be fallen into the left concave portion 47L or the right concave portion 47R. Thus, it is possible to more reliably prevent foreign matters from being accumulated at the front side of the cleaning member 51 in the progress direction.

<Other Embodiments>

In the embodiment 1, since foreign matters collected by the cleaning member 51 are mainly fallen into the right concave portion 47R, it is not always necessary to provide the left concave portion 47L.

In the embodiment, as an example of the image forming apparatus 1 including the optical scanning device 4, a printer has been described; however, the technology of the present disclosure is not limited thereto and an image forming apparatus, for example, may be a multifunctional peripheral, a copy machine, a facsimile and the like.

INDUSTRIAL APPLICABILITY

As described above, the present invention relates to an optical scanning device and an image forming apparatus including the same.

What is claimed is:

1. An optical scanning device comprising:

a housing having a light emitting port, which extends in a predetermined direction;

a transparent cover that closes the light emitting port;

a freely rotatable screw shaft arranged so as to extend in the predetermined direction along the transparent cover and formed on a peripheral surface thereof with a spiral groove;

a holding member having a cylindrical nut part fitted to and engaged with the screw shaft and reciprocally moving along the predetermined direction according to rotation of the screw shaft; and a cleaning member held to the holding member and reciprocally moving on a surface of the transparent cover according to the reciprocal movement of the holding member, thereby cleaning the surface of the transparent cover, wherein the cleaning member is configured such that a front side surface of the cleaning member in a progress direction during the reciprocal movement serves as an inclination surface obliquely crossing the progress direction when viewed from a direction vertical to the surface of the transparent cover, wherein at an outer side of the transparent cover in a direction perpendicular to the progress direction, a concave portion is formed to allow foreign matter moving to the outer side along the inclination surface according to the movement of the cleaning member to fall, wherein the cleaning member has a diamond shape having one diagonal extending in the progress direction and another diagonal extending in the direction perpendicular to the progress direction when viewed from the direction vertical to the surface of the transparent cover, and four sides corresponding to four oblique sides of the diamond are configured to serve as the inclination surface during the reciprocal movement of the cleaning member.

2. An image forming apparatus including the optical scanning device of claim 1.

3. An The optical scanning device of comprising:

a housing having a light emitting port, which extends in a predetermined direction;

a transparent cover that closes the light emitting port;

a freely rotatable screw shaft arranged so as to extend in the predetermined direction along the transparent cover and formed on a peripheral surface thereof with a spiral groove;

a holding member having a cylindrical nut part fitted to and engaged with the screw shaft and reciprocally moving along the predetermined direction according to rotation of the screw shaft; and a cleaning member held to the holding member and reciprocally moving on a surface of the transparent cover according to the reciprocal movement of the holding member, thereby cleaning the surface of the transparent cover, wherein the cleaning member is configured such that a front side surface of the cleaning member in a progress direction during the reciprocal movement serves as an inclination surface obliquely crossing the progress direction when viewed from a direction vertical to the surface of the transparent cover, wherein at an outer side of the transparent cover in a direction perpendicular to the progress direction, a concave portion is formed to allow foreign matter moving to the outer side along the inclination surface according to the movement of the cleaning member to fall, wherein the light emitting port is a pair of light emitting ports formed in parallel with one another in a direction perpendicular to the predetermined direction, wherein the holding member is arranged across the pair of light emitting ports when viewed from the direction vertical to the surface of the transparent cover, wherein the cleaning member for cleaning the transparent cover covering one of the light emitting ports is held at one side of the cylindrical nut part in the holding member while the cleaning member for cleaning the transparent cover covering a remaining one of the light emitting ports is held at another side of the cylindrical nut part, wherein the cylindrical nut part fitted to the screw shaft is formed at a position offset to one side from a center position of the holding member in the direction perpendicular to the progress direction, and the inclination surface of the cleaning member is a surface formed when the holding member is inclined with respect to the progress direction during the reciprocal movement.

4. The optical scanning device of claim 3, wherein the pair of light emitting ports is two pairs of light emitting ports, each of the two pairs of light emitting portions being a set of light emitting ports, and wherein a cleaning mechanism including the screw shaft, the holding member, and the pair of cleaning members is provided to each of the two sets of light emitting ports, wherein the optical scanning device further comprises:

one common driving motor that drives the screw shafts of both of the cleaning mechanisms; and a gear mechanism provided between the driving motor and each of the screw shafts, and wherein the cylindrical nut part engaged with one of the screw shafts is formed at a position offset to a side near the driving motor from a center position of the holding member in the direction perpendicular to the progress direction.

* * * * *